US006398028B1

(12) United States Patent
Stovall

(10) Patent No.: US 6,398,028 B1
(45) Date of Patent: Jun. 4, 2002

(54) PIZZA DELIVERY SYSTEM AND METHOD

(76) Inventor: James G. Stovall, 2022 Woodbriar Loop S., Lakeland, FL (US) 33813

( * ) Notice: Subject to any disclaimer, the term of this patent is extended or adjusted under 35 U.S.C. 154(b) by 0 days.

(21) Appl. No.: 09/635,047

(22) Filed: Aug. 4, 2000

(51) Int. Cl.[7] ..... A45C 11/20; B65D 85/00; B65H 5/28

(52) U.S. Cl. ..... 206/390; 40/312; 206/459.5; 206/807; 206/820; 221/73; 221/283; 229/102; 312/34.8; 426/115

(58) Field of Search ..... 206/390, 411, 206/807, 820; 40/312; 229/102, 103; 476/115, 120, 124; 221/70, 73, 283, 282; 312/34.8, 34.19, 34.24

(56) References Cited

U.S. PATENT DOCUMENTS

| | | | | | |
|---|---|---|---|---|---|
| 2,013,299 | A | | 9/1935 | Byrne | |
| 2,343,064 | A | * | 2/1944 | Kjorsvik | 312/34.8 |
| 2,845,728 | A | * | 8/1958 | Huber | 40/312 |
| 3,252,234 | A | * | 5/1966 | Goodman | 40/312 |
| 3,854,581 | A | * | 12/1974 | Jones, Jr. | 206/459.1 |
| 4,009,793 | A | | 3/1977 | Minesinger et al. | |
| 4,184,701 | A | | 1/1980 | Franklin et al. | |
| 4,546,881 | A | | 10/1985 | Tasma | |
| 4,574,979 | A | * | 3/1986 | Hackett | 221/73 |
| 4,954,210 | A | * | 9/1990 | Desmond | 221/73 |
| 4,972,953 | A | | 11/1990 | Friedman et al. | |
| D359,450 | S | | 6/1995 | Thomas | |
| 5,551,729 | A | * | 9/1996 | Morgan | 206/807 |
| 5,803,345 | A | * | 9/1998 | Jones et al. | 229/102 |
| 5,971,262 | A | * | 10/1999 | Moore et al. | 229/102 |

* cited by examiner

*Primary Examiner*—Bryon P. Gehman

(57) ABSTRACT

A pizza delivery system and method is provided for insuring a pizza box has not been opened prior to delivery to the consumer. The pizza delivery system includes a tape dispenser for dispensing numbered pieces of tape used to seal a box in which fresh pizza has been placed for delivery to a consumer. The pizza delivery method generally provides for sealing the pizza box with a piece of numbered tape, reporting the number on the piece of tape to the consumer at the time the order is placed, and permitting the consumer to refuse the pizza if the piece of tape has been broken or removed prior to delivery of the pizza thus insuring the pizza has not been tampered with during delivery of the pizza.

6 Claims, 3 Drawing Sheets

42
28
4
44

34
66
44
32
PIZZA
0322
PIZZA
20
0321
PIZZA
20
23
36
26

PIZZA DELIVERY SYSTEM AND METHOD

BACKGROUND OF THE INVENTION

1. Field of the Invention

The present invention relates to pizza delivery assemblies and methods and more particularly pertains to a new pizza delivery system and method for insuring a pizza box has not been opened prior to delivery to the consumer.

2. Description of the Prior Art

The use of pizza delivery assemblies and methods is known in the prior art. More specifically, pizza delivery assemblies and methods heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,013,299; U.S. Pat. No. Des. 359,450; U.S. Pat. Nos. 4,009,793; 4,645,881; 4,972,953; and 4,184,701.

While these devices fulfill their respective, particular objectives and requirements, the aforementioned patents do not disclose a new pizza delivery system and method. The inventive device includes a tape dispenser for dispensing numbered pieces of tape used to seal a box in which fresh pizza has been placed for delivery to a consumer. The inventive method generally provides for sealing the pizza box with a piece of numbered tape, reporting the number on the piece of tape to the consumer at the time the order is placed, and permitting the consumer to refuse the pizza if the piece of tape has been broken or removed prior to delivery of the pizza thus insuring the pizza has not been tampered with during delivery of the pizza.

In these respects, the pizza delivery system and method according to the present invention substantially departs from the conventional concepts and designs of the prior art, and in so doing provides an apparatus primarily developed for the purpose of insuring a pizza box has not been opened prior to delivery to the consumer.

SUMMARY OF THE INVENTION

In view of the foregoing disadvantages inherent, in the known types of pizza delivery assemblies and methods now present in the prior art, the present invention provides a new pizza delivery system and method wherein the same can be utilized for insuring a pizza box has not been opened prior to delivery to the consumer.

The general purpose of the present invention, which will be described subsequently in greater detail, is to provide a new pizza delivery system and method which has many of the advantages of the pizza delivery assemblies and methods mentioned heretofore and many novel features that result in a new pizza delivery system and method which is not anticipated, rendered obvious, suggested, or even implied by any of the prior art pizza delivery assemblies and methods, either alone or in any combination thereof.

To attain this, the present invention generally comprises a tape dispenser for dispensing numbered pieces of tape used to seal a box in which fresh pizza has been placed for delivery to a consumer. The inventive method generally provides for sealing the pizza box with a piece of numbered tape, reporting the number on the piece of tape to the consumer at the time the order is placed, and permitting the consumer to refuse the pizza if the piece of tape has been broken or removed prior to delivery of the pizza thus insuring the pizza has not been tampered with during delivery of the pizza.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pizza delivery system and method which has many of the advantages of the pizza delivery assemblies and methods mentioned heretofore and many novel features that result in a new pizza delivery system and method which is not anticipated, rendered obvious, suggested, or even implied by any of the prior art pizza delivery assemblies and methods, either alone or in any combination thereof.

It is another object of the present invention to provide a new pizza delivery system that may be easily and efficiently manufactured and marketed.

It is a further object of the present invention to provide a new pizza delivery system that is of a durable and reliable construction.

An even further object of the present invention is to provide a new pizza delivery system and method which is susceptible of a low cost of manufacture with regard to both materials and labor, and which accordingly is then susceptible of low prices of sale to the consuming public, thereby making such pizza delivery system and method economically available to the buying public.

Still yet another object of the present invention is to provide a new pizza delivery system and method which provides in the apparatuses and methods of the prior art some of the advantages thereof, while simultaneously overcoming some of the disadvantages normally associated therewith.

Still another object of the present invention is to provide a new pizza delivery system and method for insuring a pizza box has not been opened prior to delivery to the consumer.

Yet another object of the present invention is to provide a new pizza delivery system which includes a tape dispenser for dispensing numbered pieces of tape used to seal a box in which fresh pizza has been placed for delivery to a consumer. The inventive method generally provides for sealing the pizza box with a piece of numbered tape, reporting the number on the piece of tape to the consumer at the time the order is placed, and permitting the consumer to refuse the pizza if the piece of tape has been broken or removed prior to delivery of the pizza thus insuring the pizza has not been tampered with during delivery of the pizza.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
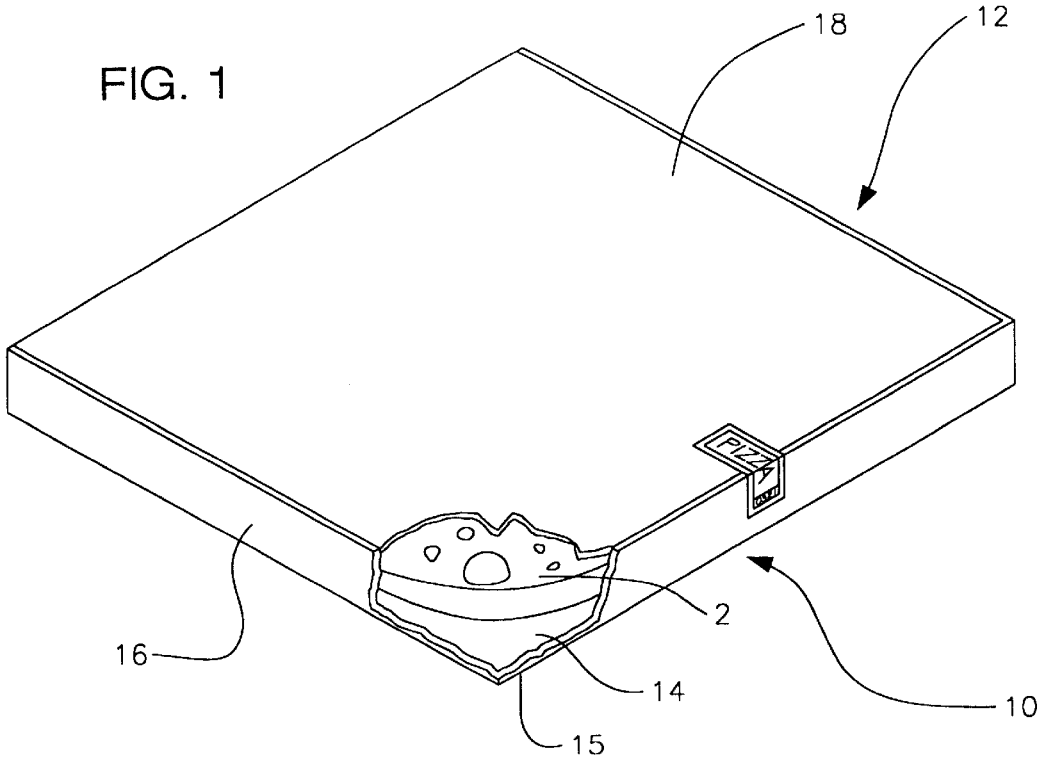
FIG. 1 is a perspective view of a box of a new pizza delivery system according to the present invention.
Figure 2:
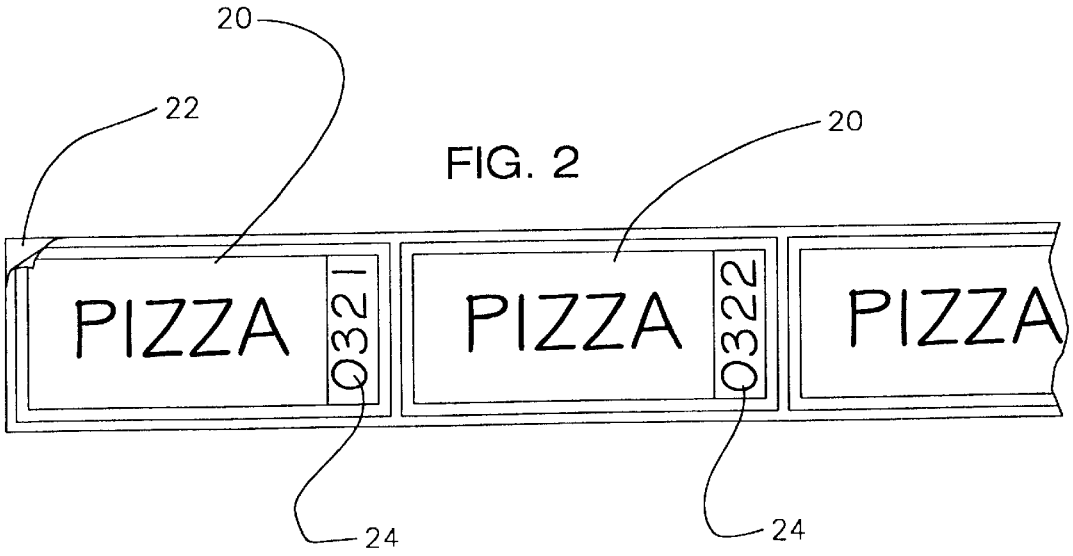
FIG. 2 is a perspective view, of the present invention in use.
Figure 3:
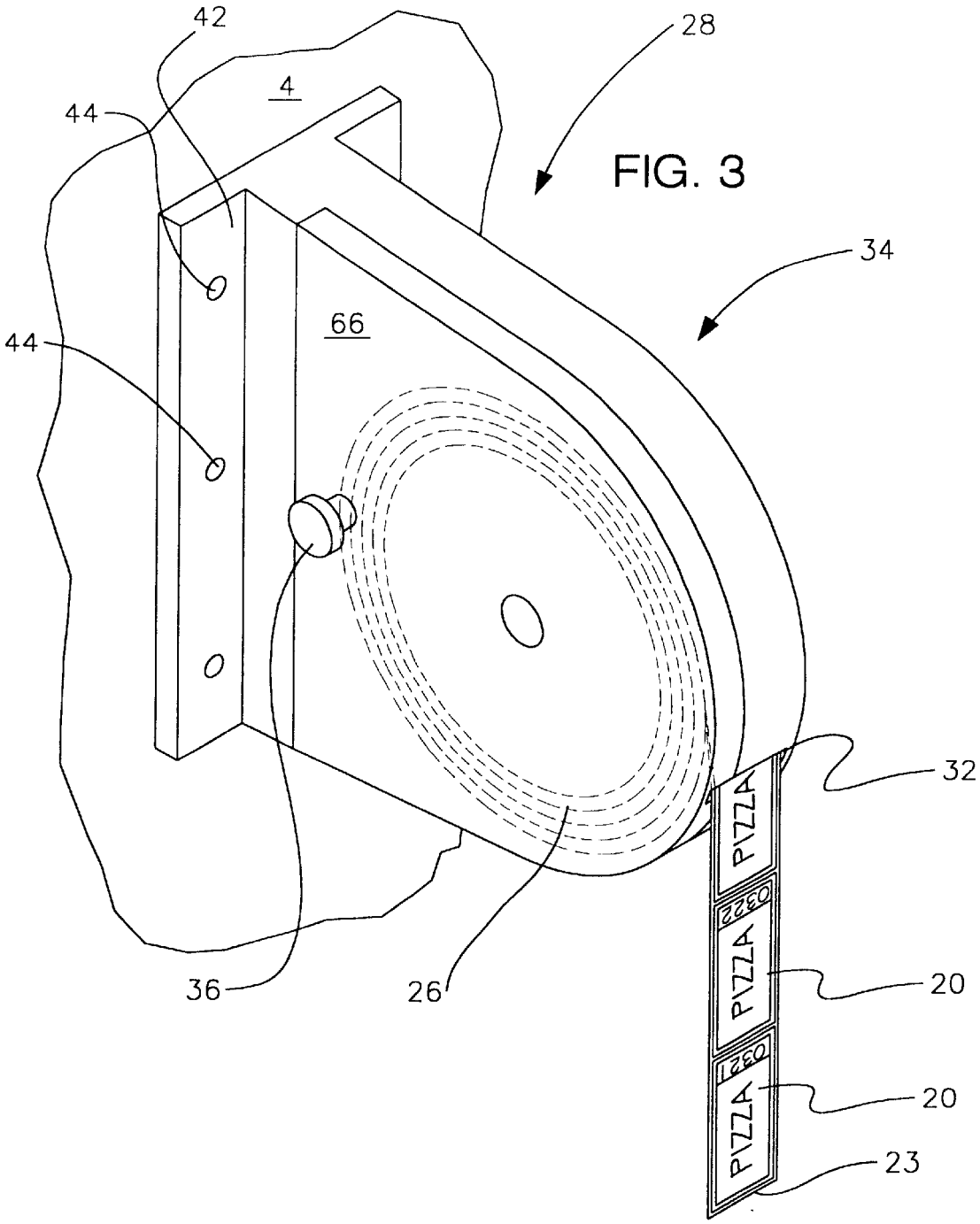
FIG. 3 is a top view of the tape of the present invention.
Figure 4:
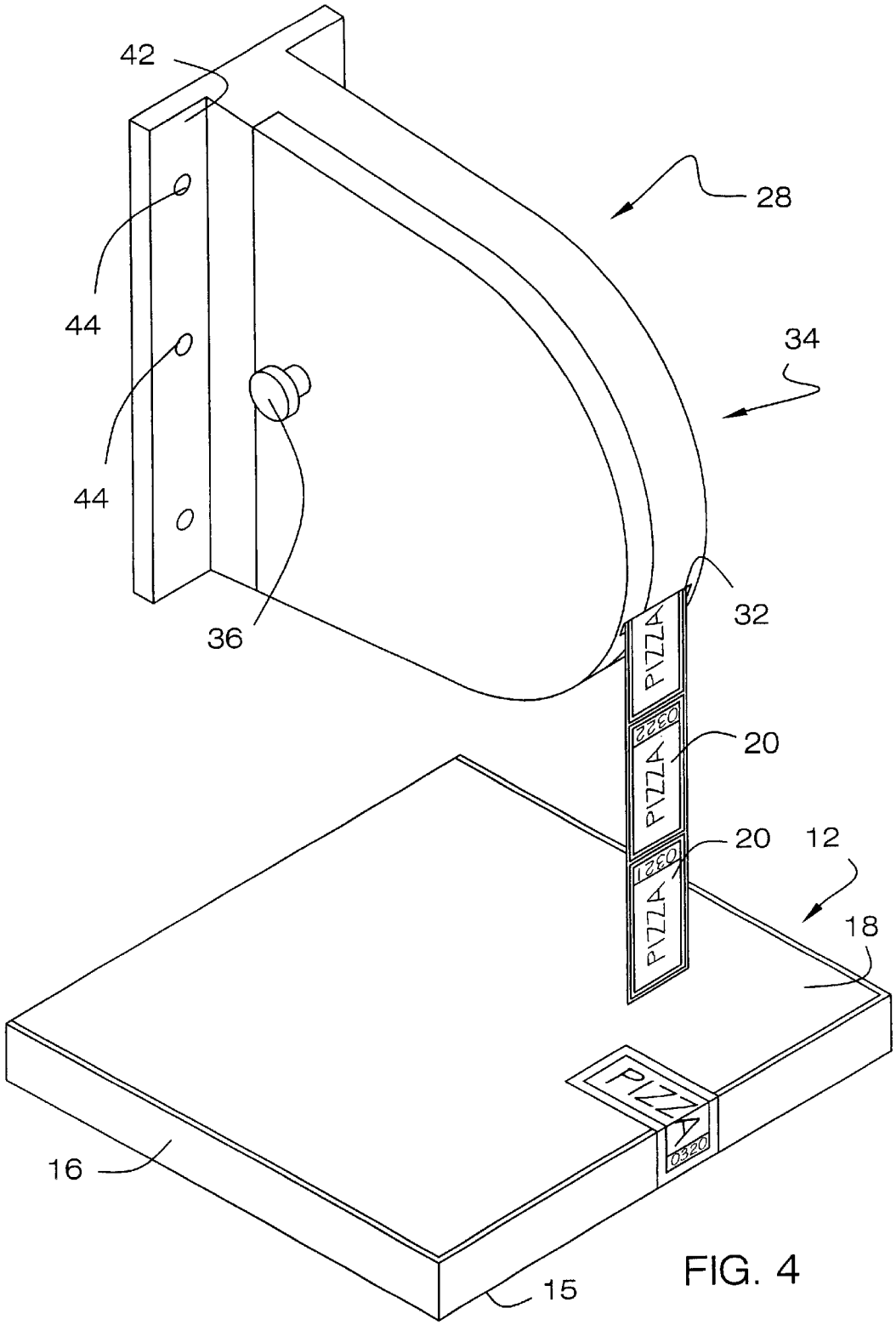
FIG. 4 is a perspective view of a new pizza delivery system according to the present invention.

With reference now to the drawings, and in particular to FIGS. 1 through 3 thereof, a new pizza delivery system and method embodying the principles and concepts of the present, invention and generally designated by the reference numeral 10 will be described.

As best illustrated in FIGS. 1 through 3, the pizza delivery system and method 10 generally comprises a box 12 having a bottom 14, a perimeter wall 16 extending upwardly from a perimeter edge 15 of the bottom 14 of the box 12, and a top 18 pivotally coupled to the perimeter wall 16 such that the top 18 is pivotable between and open and a closed position. Thus the box 12 is designed for surrounding a pizza 2 inside the box 12 when the top 18 is in the closed position.

A piece of tape 20 is engageable to the box 12 such that the piece of tape 20 extends between the top 18 and the perimeter wall 16 when the top 18 is in the closed position. Thus, the piece of tape 20 prevents pivoting the top 18 of the box 12 into the open position without breaking the piece of tape 20. Thus, the piece of tape 20 is designed for indicating to a buyer of the pizza 2 that the box 12 has not been opened since the piece of tape 20 was engaged to the box 12.

In an embodiment of the invention, the piece of tape 20 is a selectable piece of tape from a plurality of pre-cut pieces of tape 20. Each of the pieces of tape is removably coupled to a backing strip 22.

Each of the pre-cut pieces of tape 20 has indicia 24 for distinguishing each piece of tape 20 from each other piece of tape 20. Thus, each piece of tape 20 is identifiable from the other pieces of tape 20 for permitting a person placing the pizza 2 into the box 12 to communicate the indicia 24 on a selected one of the pieces of tape 20 to the buyer of the pizza 2.

In an embodiment, the indicia 24 is sequential numbering of each piece of tape 20 on the backing strip 22.

The plurality of pieces of tape 20 on the backing strip 22 is formed into a roll 26.

A housing 28 is provided for holding the roll 26. The housing includes a slot 32 for permitting a distal end 23 of the backing strip 22 to pass out of the housing 28 for facilitating access to an end positioned one of the pieces of tape 20.

The housing 28 further includes a door 66 pivotally coupled to a main portion 34 of the housing 28.

A thumbscrew 36 is coupled to the door 66 for selectively coupling the door 66 to the main portion 34 of the housing 28 for holding the door 66 in a closed position.

The housing 28 further has a connection portion 42 having a plurality of connection holes 44. Thus, the connection portion 42 is designed for coupling to a wall 4.

In use, the buyer orders a pizza and is given the identifying number of a specific piece of tape that is used to seal the pizza box immediately after the pizza is placed in the pizza box for delivery. Upon inspection of the pizza box, the buyer may easily identify whether the tape is in an unbroken condition or if the tape has otherwise been tampered with. The buyer may also use the identifying number to confirm that the pizza is the correct one ordered by the buyer without having to open the pizza box.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A pizza delivery system comprising:

a box having a bottom, a perimeter wall extending upwardly from a perimeter edge of said bottom of said box, and a top pivotally coupled to said perimeter wall such that said top is pivotable between and open and a closed position whereby said box is adapted for surrounding a pizza inside said box when said top is in said closed position;

a piece of tape being engageable to said box such that said piece of tape extends between said top and said perimeter wall when said top is in said closed position whereby said piece of tape prevents pivoting said top of said box into said open position without breaking said piece of tape whereby said piece of tape is adapted for indicating to a buyer of the pizza that the box has not been opened since said piece of tape was engaged to said box;

said piece of tape being a selectable piece of tape from a plurality of pre-cut pieces of tape, each of said pieces of tape being removably coupled to a backing strip;

said plurality of pieces of tape on said backing strip being formed into a roll;

a housing for holding said roll, said housing having a slot for permitting a distal end of said backing strip to pass out of said housing for facilitating access to an end positioned one of said pieces of tape;

said housing having a door pivotally coupled to a main portion of said housing; and a thumbscrew coupled to said door for selectively coupling to said main portion of said housing for holding said door in a closed position.

2. The pizza delivery system of claim 1, further comprising:

each of said pre-cut pieces of tape having indicia for distinguishing said piece of tape from each other piece of tape whereby each piece of tape is identifiable from said other pieces of tape for permitting a person placing the pizza into said box to communicate said indicia on a selected one of said pieces of tape to the buyer of the pizza.

3. The pizza delivery system of claim 2, further comprising:

said indicia being sequential numbering of each said piece of tape on said backing strip.

4. The pizza delivery system of claim 1, further comprising:

said housing having a connection portion including a plurality of connection holes whereby said connection portion is adapted for coupling to a wall.

5. A pizza delivery system comprising:

a box having a bottom, a perimeter wall extending upwardly from a perimeter edge of said bottom of said box, and a top pivotally coupled to said perimeter wall such that said top is pivotable between and open and a closed position whereby said box is adapted for surrounding a pizza inside said box when said top is in said closed position;

a piece of tape being engageable to said box such that said piece of tape extends between said top and said perimeter wall when said top is in said closed position whereby said piece of tape prevents pivoting said top of said box into said open position without breaking said piece of tape whereby said piece of tape is adapted for indicating to a buyer of the pizza that the box has not been opened since said piece of tape was engaged to said box;

said piece of tape being a selectable piece of tape from a plurality of pre-cut pieces of tape, each of said pieces of tape being, removably coupled to a backing strip;

each of said pre-cut pieces of tape having indicia for distinguishing said piece of tape from each other piece of tape whereby each piece of tape is identifiable from said other pieces of tape for permitting a person placing the pizza into said box to communicate said indicia on a selected one of said pieces of tape to the buyer of the pizza;

said indicia being sequential numbering of each said piece of tape on said backing strip;

said plurality of pieces of tape on said backing strip being formed into a roll;

a housing for holding said roll, said housing having a slot for permitting a distal end of said backing strip to pass out of said housing for facilitating access to an end positioned one of said pieces of tape;

said housing having a door pivotally coupled to a main portion of said housing;

a thumbscrew coupled to said door for selectively coupling to said main portion of said housing for holding said door in a closed position; and said housing having a connection portion including a plurality of connection holes whereby said connection portion is adapted for coupling to a wall.

6. A method of delivering a pizza, the steps of the method comprising:

providing a box having a bottom, a perimeter wall extending upwardly from a perimeter edge of said bottom of said box, and a top pivotally coupled to said perimeter wall such that said top is pivotable between and open and a closed position;

providing a piece of tape engageable to said box;

placing a pizza into said box;

closing said top of said box;

engaging said piece of tape to said box such that said piece of tape extends between said top and said perimeter wall when said top is in said closed position whereby said piece of tape prevents pivoting said top of said box into said open position without breaking said piece of tape whereby said piece of tape is adapted for indicating to a buyer of the pizza that the box has not been opened since said piece of tape was engaged to said box;

delivering said pizza to the buyer;

providing indicia on said piece of tape for identifying said piece of tape;

reporting said indicia to the buyer when the buyer orders said pizza; and permitting the buyer to view said indicia on said piece of tape for identifying for facilitating confirmation that said pizza conforms to specifications given by the buyer when the buyer ordered said pizza.

* * * * *